United States Patent [19]

Raisin et al.

[11] 4,432,295

[45] Feb. 21, 1984

[54] PROCESSING METHOD AND APPARATUS FOR RECTANGULAR PIECES OF FABRIC

[75] Inventors: Jean-Pierre Raisin, Troyes; Bernard Helffer, Saint Andre-les-Vergers; Jean L. Chirouze, Chomerac, all of France

[73] Assignees: Institut Textile de France, Boulogne; Agence Nationale de Valorisation de la Recherche (Anvar), Paris; Meca, Chomerac, all of France

[21] Appl. No.: 339,415

[22] Filed: Jan. 15, 1982

[30] Foreign Application Priority Data

Jan. 16, 1981 [FR] France ..... 81 00832

[51] Int. Cl.[3] ..... D05B 35/02; D05B 19/00; D05B 1/08

[52] U.S. Cl. ..... 112/262.3; 112/141; 112/304; 112/121.11; 112/155

[58] Field of Search ..... 112/262.3, 141, 142, 112/143, 147, 136, 153, 304, 306, 318, 121.11, 155, 163

[56] References Cited

U.S. PATENT DOCUMENTS

| | | | |
|---|---|---|---|
| 2,845,885 | 8/1958 | Scarrone . | |
| 3,477,397 | 11/1969 | Hawley . | |
| 3,981,255 | 9/1976 | Taylor | 112/155 |
| 4,152,996 | 5/1979 | Van Amburg | 112/121.11 X |
| 4,154,180 | 6/1979 | Opelika . | |
| 4,224,883 | 9/1980 | Zeigler . | |
| 4,271,774 | 6/1981 | Burton | 112/141 |
| 4,353,316 | 10/1982 | Brocklehurst | 112/262.3 |

FOREIGN PATENT DOCUMENTS

| | | |
|---|---|---|
| 2166436 | 8/1973 | France . |
| 2178562 | 11/1973 | France . |

*Primary Examiner*—Peter P. Nerbun
*Attorney, Agent, or Firm*—Shenier & O'Connor

[57] ABSTRACT

The present invention relates to a method and apparatus for processing rectangular pieces of fabric wherein the piece of fabric is moved in a first direction until the front edge reaches and is held in a predetermined front position, whereas the remaining part of said piece continues to move in said first direction until the rear edge reaches and is held in a predetermined rear position. The piece is thereafter moved in a second position while the front and rear edges are kept apart at a predetermined distance, and the aforesaid edges are hemmed simultaneously by hemming machines. The method and device according to the invention are used for hemming pieces having two parallel edges, and in particular rectangular pieces cut from a continuous web of fabric, such as for example floor cloths.

26 Claims, 8 Drawing Figures

PROCESSING METHOD AND APPARATUS FOR RECTANGULAR PIECES OF FABRIC

The present invention relates to a method for processing pieces of fabric having rear and front parallel edges said method being of the type which consists in moving the piece in a first direction perpendicular to the two parallel edges, said piece being driven in a second direction substantially perpendicular to the first without the orientation of the edges being altered, and in simultaneously hemming the two edges whilst the piece is moved in said second direction.

In methods of this type, it is desirable to hem the two edges of each piece with the sewing heads of a fixed station. However, hemming requires an accurate presentation of the fabric to the needle, of more or less two millimeters: if an excess of fabric is presented, "packing" occurs in the hemming guide; if some fabric is missing, the hem is not complete.

A particular hemming method is known from French Pat. No. 2 166 436 and from its addition No. 2 178 562 which consists in the following operations: treatment of a first edge, followed by folding over more than half the piece of fabric along a folding line parallel to its cut edges and in such a way that its second unprocessed edge is situated beyond its first processed edge, and processing of the second edge of the piece. No solution has really been sought in this method to solve any problems of variation of the width of the piece: it is just recommended to level the cut edges, using two fettling devices integral with two sewing machines. This being equivalent to saying that any variations in the width are simply eliminated by cutting the excess of fabric, which of course entails a loss of said fabric. It also necessitates adjusting the equipment for each batch of pieces to be hemmed which present any differences in width, even if only small ones.

It is the object of the present invention to overcome the aforesaid disadvantages by proposing a hemming method which makes it possible to hem accurately a batch of pieces of fabric which may show width differences.

This object is reached according to the invention due to the fact that:

(a) the piece of fabric is moved in the first direction until the front edge of said piece reaches a predetermined front position and said front edge is kept in that predetermined position;

(b) whilst said edge is so held, the remaining part of the piece is moved in the first direction until the rear edge reaches a predetermined rear position, and the remaining part of the piece moving in the first direction is stopped and the rear edge is held in its predetermined position;

(c) the piece is moved in the second direction, the edges being kept apart, at a distance which corresponds to the distance separating the predetermined front and rear positions.

Advantageously, the arrival of the front and rear edges into their respective predetermined positions is detected by respective sensor means which generate a signal causing the edges to be held in their respective predetermined position.

Advantageously, the front and rear edges are respectively held in their predetermined position by lowering rear and front clamping belts on to the piece in the area of said edges.

Advantageously, said clamping belts are used at least to start moving the piece in the second direction.

Advantageously, an endless belt is used for moving the piece in the first direction once said piece has been cut.

Advantageously, an extra feeding roller is used to move the remaining part of the piece in the first direction while the front edge is clamped in position.

Advantageously, one piece of fabric is moved in the second direction through the whole time when the cut edges of another processed piece are not clamped in their predetermined position.

Advantageously, the front edge is clamped in its predetermined position once said edge has been aligned with an abutment which is transversal to the first direction.

Although the invention is applicable to the processing of any pieces of fabric with parallel front and rear edges, whatever their shape (trapezoidal, rectangular, square, etc.) it is more particularly adapted to a method which comprises: drawing a continuous web of fabric from a roll of fabric, moving said web in the first direction and periodically cutting into said web transversely to said first direction, pieces of fabric to size.

Advantageously, the selvages of the continuous web of fabric are hemmed prior to cutting.

Advantageously, the processing end with the piece being folded and stacked with the precedingly processed pieces.

The invention further relates to a device which comprises specific means for carrying out the different stages of the method according to the invention, and in particular:

(a) means for moving the piece in the first direction until the front edge of the piece reaches a predetermined front position and means to keep the front edge in said predetermined position;

(b) means for moving the remaining part of the piece in the first direction whilst the front edge is held stationary and until the rear edge reaches a predetermined rear position; means for stopping the remaining part of the piece moving in the first direction once the rear edge has reached its predetermined position and means for holding the rear edge in its predetermined position;

(c) all of the aforesaid means being associated to means for moving the piece in the second direction, means for holding the front and rear edges apart, at a distance which corresponds to the distance between the predetermined rear and front positions.

Advantageously, the device is provided with rear and front sensor means detecting the arrival of the rear and front edges to their respective predetermined positions, and generating a signal which causes the front and rear edges to be held in their respective predetermined position by means provided to this effect.

Advantageously, said means provided for holding the front and rear edges in their respective predetermined position are constituted by front and rear clamping belts adapted to be lowered on to the piece, close to the said edges.

Advantageously, said means are endless belts adapted to rotate and to at least start moving the piece in the second direction.

Advantageously, said belts alone move the piece in the second direction, and comprise a fixed portion situated higher up, for example on the level of the hemming means and a movable portion also higher up, situated for example above the area where the front and rear edges of a piece are held in their predetermined position.

Advantageously, the belts are vertically movable as a whole and only contribute to starting to move the piece in the second direction, the device being provided downstream of said belts with stationary means taking over the driving of the piece in the second direction.

Advantageously, the device is provided with an abutment transverse to the first direction, and with sensor means associated to a time-delay circuit so that the means provided for clamping the front edge in position are actuated after the front edge of a piece has been aligned with the abutment.

The invention will be more readily understood on reading the following description with reference to the accompanying drawings in which.

Figure 1:
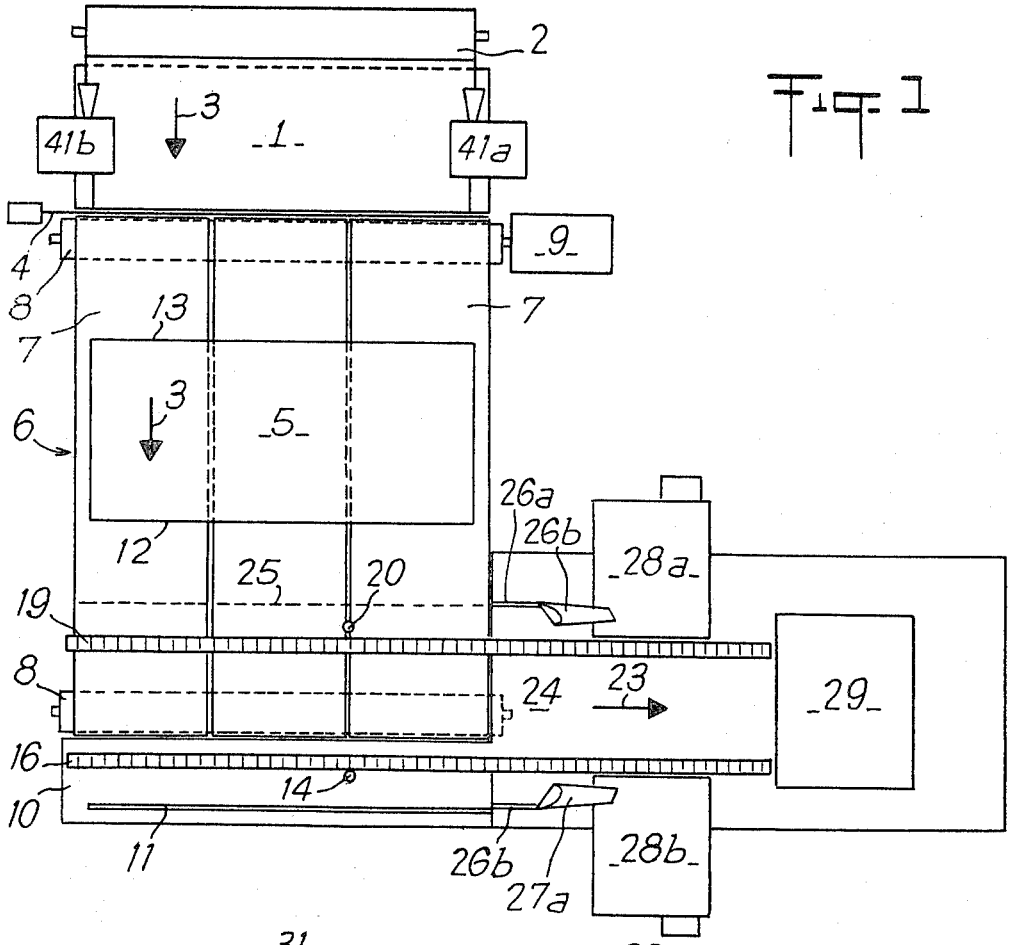
FIG. 1 is a diagrammatical plan view of a device according to the invention.

FIG. 1 shows a continuous web of fabric 1 pulled by an assembly of conventional means (not shown) from a roll of fabric 2 and moved in a first direction (arrows 3) by known means.

In likewise conventional manner, the free front end of the web 1 advances in discontinued fashion (for example by intermediate driving means) to be cut across by cutting means 4 such as shears, a knife, etc.

Such an assembly of means is already known and for this reason it will not be described in any more details.

After cutting, each piece of fabric 5 is moved in the first direction 3 by an endless conveyor belt 6, constituted by one or preferably more than one individual belt 7, supported and driven by shafts 8, one of which at least is a driving shaft controlled by a control device 9.

To facilitate the cutting of the pieces by the means 4 and in particular to prevent the sliding of the fabric towards the rear part of the belt during the cutting operation, means (not shown) may be provided to apply the piece on the belt, said means being meant to hold the said piece in position during the cutting operation. The said means which may be for example situated perpendicular to the roller 8, may be pressing rollers; more advantageously, said means may consist in a shaft which is parallel to the roller 8 and is provided on its surface, along a generating line with a series of fingers, normal on the surface, compressible lengthwise, and ending into rubber buffers. At the time when the belt stops for the piece to be cut, the shaft pivots in such a way that the fingers are applied against the piece, and that said piece is both stretched and immobilized, and the cutting operation is problem-free. The shaft then pivots back to release the piece when the belt starts moving again.

Said belt 6 is extended, in the first direction by a fixed table 10 across which is fixed an abutment 11.

The cut piece of fabric 5 is moved by the belt 6 until its front edge 12 reaches a predetermined front position which coincides with the abutment 11.

An optical or mechanical sensor member 14 is provided at the front perpendicularly to the table 10 to detect the arrival of the front edge 12. Said sensor member is advantageously of the photo-sensitive type, sending and receiving a ray of light reflected by a mirror 15, placed inside the table or under the table, in which latter case said table will have been provided with a passage for the light.

Figure 5:
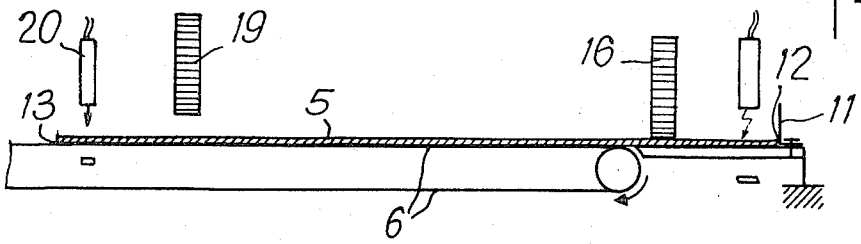
FIG. 5 shows the same view as FIG. 4, once the front belt has been lowered.

The sensor member is associated to a time-delay circuit which generates a signal controlling the lowering of the front clamping belt 16, (FIG. 5); said belt being situated across the first direction 3 and perpendicularly to the fixed table 10.

The delay is calculated first in relation to the distance between the sensor member 14 and the abutment 11, and second, so that the clamping belt 16 is lowered just after the front edge has been adequately aligned with the abutment 11, in order to make good any small misalignment of said front edge 12.

The length (in the direction of 3) of the table 10 is selected to be as small as possible, bearing in mind that it is related to the distance between the belt 16 and the abutment 11, said distance being itself determined in relation to the optimum position of the sewing needle of the hemming machine to obtain an optimum hem.

In order that the detection operation and the operation consisting in clamping the front edge 12 in position, be conducted in the best possible conditions, an extra safety sensor 17 may be provided upstream of the clamping belt 16 which extra sensor, once it has detected the arrival of the piece 5 to its level, signals to a feed control device 9 to slow down, so that the moving speed of the belt 6 is less during the detection operation and whilst the front edge is clamped in position, and returns to its normal value either at the end of said operations (which is indicated by the clamping down of the front belt 16), or after the transfer of the piece 5 in the second direction, to be described hereinafter.

Whilst the front edge 12 is clamped in position by the clamping belt 16 (and the abutment 11), the remaining part of the piece 5 continues to advance in the first direction, under the effect of the belt 6 which continues to turn and/or under the effect of an extra feeding roller 18, rotating at a peripheral feeding speed which is greater than that of the belt 6.

The feeding roller 18 is advantageous in that it enables to speed up the advance of the remaining part of the piece 5 or else to stop the belt 6 as soon as the front edge is clamped by the belt 16 and to advance the remaining part of the piece by means of said roller only with this last solution, the clamping belt can just as well be perpendicular to the belt and not to the table 10 since said belt stops moving whilst the piece is clamped in position by said belt 16.

Moreover, the presence of the extra feeding roller 18 makes it possible to provide on the surface thereof a relatively high adherence in the direction 3, facilitating the gathering operation without interfering with the previously described transversal transfer operations, provided that a system is also provided to raise up the said extra roller during these transfer operations, or a low adherence across said roller.

According to another embodiment, for reasons of good adherence of the piece 5 on the belt 6 during the gathering of said piece, and without having for all that to provide on the surface of the belt a relatively high permanent adherence in the direction 3, it may be advantageous to replace the extra feeding roller 18 by a free pressing roller (or set of rollers, of course), said pressing roller being in resting contact against piece 5 only during the packing operation, such resting contact generally contributing to adequately increasing the friction of the piece 5 on the belt 6 so that the piece is suitably moved by said belt 6.

Figure 6:
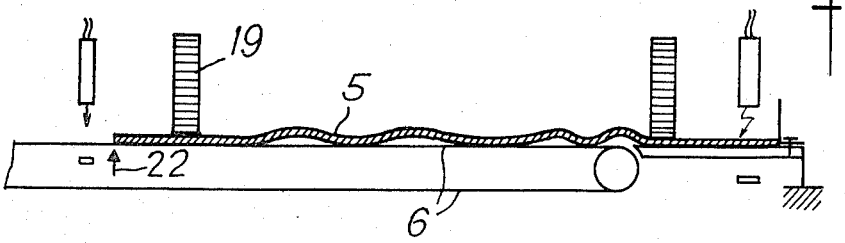
FIG. 6 shows the same view as FIG. 5, after the lowering of the front belt.
Figure 7:
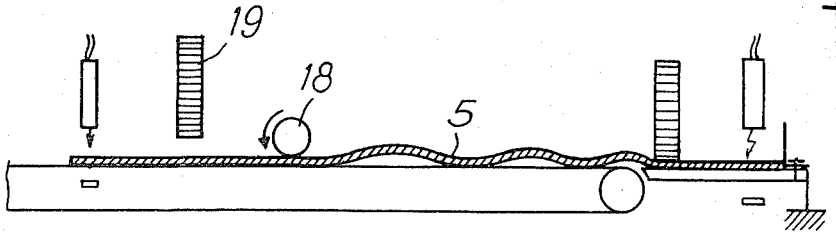
FIGS. 7 and 8 are similar views to those shown in FIGS. 5 and 6, in a device where the gathering of the piece is due to an extra driving roller.
Figure 8:
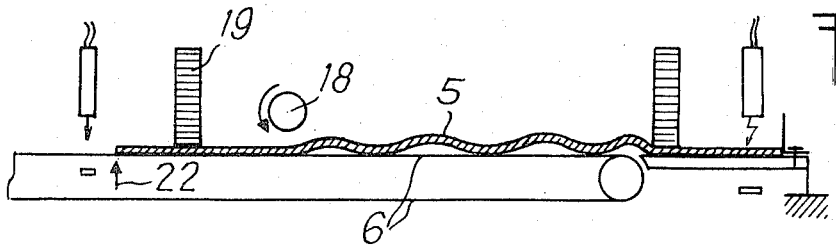

Whereas the remaining part of the piece 5 advances in direction 3, the front edge being clamped in position (FIGS. 5 or 7), a second clamping belt 19 is lowered at the rear to clamp the rear edge 13 in a predetermined rear position in response to a detection conducted by a rear sensor 20, which advantageously is of the photosensitive type with mirror 21, said mirror 21 being placed for example between two upper sides of two strips 7 of the belt 6. The response to the detection by the sensor 20 may in some cases be affected by a delay which is dependent on the respective positions of the sensor 20 and of the predetermined rear position (defined in FIGS. 6 and 8 by arrows 22).

The predetermined front and rear positions are dependent on the distance selected between the left and right hemming machines as will be seen hereinafter. Said positions having effectively been determined, the position of the sensors is selected and any time-delay circuits associated thereto are adjusted so that if the piece of fabric has a length (in direction 3) which corresponds exactly to the position of the two hemming heads, the two belts 16 and 19 are lowered simultaneously.

The belt 6 is stopped at the same time as the belt 19 is lowered, if it was not already stopped when the front clamping belt 16 was lowered.

The extra roller 18 is raised up simultaneously to the lowering of the rear clamping belt 19.

It will be lowered again when the front clamping belt 16 is lowered to clamp the front edge of the next piece 5 in position, the length of which next piece (in the direction 3), will be greater than the distance separating the two predetermined front and rear positions.

The different operations described hereinabove have permitted to position in the direction 3 the two selvages 12 and 13, whether the piece 5 was initially at the right dimension, or larger, and it has gathered between the respective lowering of the two clamping belts 16 and 19.

The piece of fabric being so positioned, and the two belts 16 and 19 having been lowered, said latter which are endless belts parallel to the second feeding direction (arrow 23, FIG. 1) substantially perpendicular to the first direction 3, are set in endless rotation in order to move the piece of fabric which passes thus from the belt 6 to a fixed transfer table 24, separate from or integral with the table 10.

The adherence of the belts 16 and 19 in the second direction 23 is greater than the adherence of the belt 6 in that same direction 23. To this effect, the belts 16 and 19 can be grooved in parallel to direction 3, and the belt 6 can be grooved in parallel to direction 23.

The piece of material leaving the belt 6 and the table 10 is moved onto table 24 by belts 16 and 19, its front and rear edges 12 and 13 being held apart at a distance corresponding to the distance separating the predetermined front and rear positions (shown in FIG. 1 by abutment 11 and the dotted line 25).

Corrective edge-guides **26*a* and 26*b* may be provided on the left and right, just preceding left and right hem-guides 27*a*, 27*b*, which in turn precede left and right hemming machines 28*a* and 28*b*** of the conventionally used type, sewing the left and right hems.

Downstream of hemming machines 28, and in conventional manner, are provided means 29 for folding and stacking up the said pieces of fabric.

It is already known to produce endless belts which are adpated to be lowered or raised due to a set of rollers moving vertically.

In order to ensure a high output rate by allowing the machine to hem a piece 5 whilst the next piece comes into position against the abutment 11, it is important that the clamping belts 16 and 19 do not move a piece in front of the hemming machines 28 and that they are not at the same time lowered on to the belt 6, which would prevent the arrival of the next piece.

Figure 2:
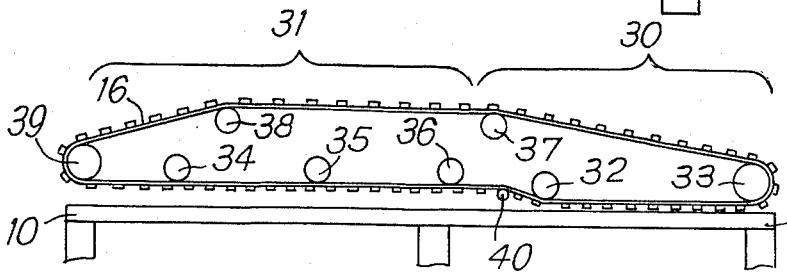
FIG. 2 is an elevational view of the front clamping belt of the device according to FIG. 1, in raised position.
Figure 3:
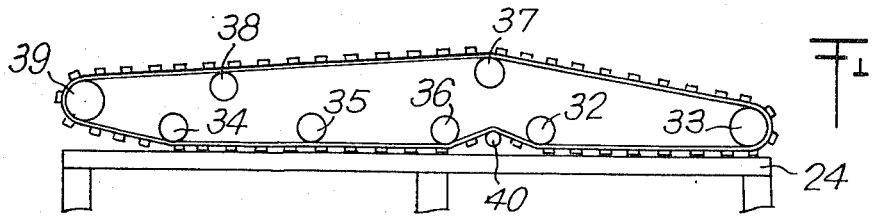
FIG. 3 shows the belt of FIG. 2 in lowered position.
Figure 4:
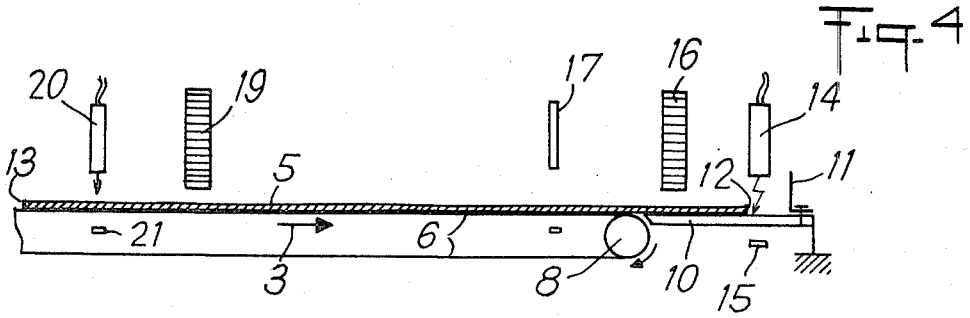
FIG. 4 is a partial left-hand view of the device of FIG. 1, showing the advance of a piece of fabric before the clamping belts are lowered.

It is therefore advantageous to construct the belts 16 and 19 as shown in FIGS. 2 and 3 wherein each belt has a vertically fixed part 30 situated in particular at the level of the hemming means 28, and a vertically movable part 31, situated for example above the area where the front and rear edges are clamped in their predetermined position, i.e. above the belt 6 or the table 10.

The fixed part 30 is provided with two rollers 32, 33 permanently pressing the belt against the worktable 24, and an upper roller 37. The rollers 32, 33 and 37 are vertically fixed.

The movable part 31, which is situated upstream of the sewing means, must be raisable (FIG. 2) to allow through the piece 5 when this comes against the abutment 11, and it must be lowerable (FIG. 3) to clamp the fabric in position and move it sideways. Said movable part 31 comprises rollers 34, 35, 36 pressing against the belt at least in the clamping area, and a roller 38 for the upper side of the belt. All said rollers are vertically movable between a high position (FIG. 2) and a low position (FIG. 3).

A fixed end roller 39 drives each belt in continuous manner except whilst the movable part 31 of the front belt 16 is lowered and the movable part 31 of the rear belt 19 is raised.

A fixed roller 40 or guide, holds each belt in a position set apart from the driving surface 6, 10, 24 in the intermediate area between the fixed part 30 and the movable part 31, in order, in particular that a piece of fabric 5 is put well back in the transverse direction 23 by the edge-guides 26 provided to correct any bad position taken by the selvages.

A stop in the movement of the belts, very short, if not nil, since it is related to a possibly excessive length (in direction 3) of a piece 5 with respect to the predetermined distance between the front and rear edges, simultaneously entails a momentary stop in the sewing function of the hemming machines 28, this creating no problem even if a piece is already engaged in the hemming machines 28.

If preferred, it is possible to replace each one of the belt 16 and 19 provided with fixed 30 and movable 31 parts, by two independent belts of which one is fixed, permanently rotating, and applies the fabric against the worktable 23 close to the sewing head, the other being vertically movable. A free space is left between the fixed and movable belts opposite the edge-guides 26.

It should be noted that in FIG. 1, the hemming machines 28 are represented as being very close to the belt 6, but in actual fact they are preferably at a distance therefrom of at least the width (in the direction 23) of a piece of fabric 5 so that the operations, which consist in placing the piece against the abutment and hemming, can take place simultaneously at a high output rate.

The belt 6 is constituted by a plurality of conveying strips 7, of which the upper sides can be separated, especially in the downstream part of the belt where the pieces of fabric 5 are moved in the second direction 23, by fixed plane surfaces acting as a slide when the clamping belts 16, 19 convey the piece of fabric 5 towards the sewing heads.

The distance between the predetermined rear and front positions (25, 11) of the edges is selected in relation to the minimum length (in the direction 3) possible for the pieces of fabric 5, so that the length of the pieces 5 can only be equal to or greater than the said distance, and can thus in every case be adjusted, owing to the invention, to the value of the said distance, this permitting a perfect hemming of the front and rear edges of the pieces of fabric.

The distance between the hemming machines **28*a* and 28*b* is adjustable, hemming machine 28*b* associated to the abutment 11 being fixed, and hemming machine 28*b* being adjustable in parallel to direction 3** by means of a slide or rail system not shown.

This therefore permits to adjust the distance between the hemming machines **28*a* and 28*b*** so as to correspond, taking into accound the width of the hems, to the distance between the predetermined positions of the edges.

The adjustable space between the hemming machines 28 makes it possible to adapt the machine according to the invention to the production of pieces of fabric of different length in each series.

The installation according to the invention is especially adapted for hemming floor cloths or sacking.

In certain applications, such as hemming dish cloths, bath towels, etc., it is necessary to hem the four edges of each piece of fabric 5. It suffices in this case to add to the aforedescribed installation, upstream of the cutting means 4, two sewing heads, a left one **41*a* and a right one 41*b* which will hem the two selvages of the continuous web 1, which continuous web is drawn from the roll 2**.

What is claimed is:

1. Method for processing a piece of fabric having rear and front parallel edges, of the type which consists in moving the piece in a first direction perpendicular to the two parallel edges, said piece being driven in a second direction substantially perpendicular to the first without the orientation of the edges being altered, and in simultaneously hemming the two edges while the piece is moved in said second direction, method wherein:

(a) the piece of fabric is moved in the first direction until the front edge of said piece reaches a predetermined front position and said front edge is kept in that predetermined position;

(b) while said front edge is so held, the remaining part of the pieces is moved in the first direction until the rear edge reaches a predetermined rear position, and the remaining part of the piece moving in the first direction is stopped and the rear edge is held in its predetermined position;

(c) the piece is moved in the second direction, the edges being kept apart, at a distance which corresponds to the distance separating the predetermined front and rear positions.

2. Method as claimed in claim 1, wherein the arrival of the front and rear edges into their respective predetermined positions is detected by respective sensor means which generate a signal causing the edges to be held in their respective predetermined position.

3. Method as claimed in claim 1, wherein the front and rear edges are respectively held in their predetermined position by lowering rear and front clamping belts on to the piece in the area of said edges.

4. Method as claimed in claim 3, wherein said clamping belts are used at least to start moving the piece in the second direction.

5. Method as claimed in claim 1, wherein an endless belt is used for moving the piece in the first direction once said piece has been cut.

6. Method as claimed in claim 1, wherein an extra feeding roller is used to move the remaining part of the piece in the first direction while the front edge is clamped in position.

7. Method as claimed in claim 6, wherein the speed of the extra driving roller is greater than the speed at which the cut piece is moved.

8. Method as claimed in claim 1, wherein one piece of fabric is moved in the second direction through the whole time when the cut edges of another processed piece are not clamped in their predetermined position.

9. Method as claimed in claim 1, wherein the front edge is clamped in its predetermined position once said edge has been aligned with an abutment which is transverse to the first direction.

10. Method as claimed in claim 1, consisting in, first drawing a continuous web of fabric from a roll of fabric, moving said web in the first direction and periodically cutting into said web, transversely to said first direction, pieces of fabric to size.

11. Method as claimed in claim 1, wherein the selvages of the continuous web of fabric are hemmed prior to cutting.

12. Method as claimed in claim 1, wherein the processing ends with the piece being folded and stacked with the precedingly processed pieces.

13. Device for processing pieces of fabric having rear and front parallel edges, which device comprises means for moving the pieces in a first direction perpendicular to the rear and front parallel edges, means for moving the pieces in a second direction substantially perpendicular to the first, the orientation of the parallel edges remaining unchanged, means for simultaneously hemming the two edges while the pieces are moved in the second direction, wherein said device further comprises:

(a) means for moving the piece in the first direction until the front edge of the piece reaches a predetermined front position and means to keep the front edge to said predetermined position;

(b) means for moving the remaining part of the piece in the first direction while the front edge is held stationary and until the rear edge reaches a predetermined rear position; means for stopping the remaining part of the piece moving in the first direction once the rear edge has reached its predetermined position and means for holding the rear edge in its predetermined position;

(c) all of the aforesaid means being associated to means for moving the piece in the second direction, means for holding the front and rear edges apart, at a distance which corresponds to the distance between the predetermined rear and front positions.

14. Device as claimed in claim 13, wherein said device is provided with rear and front sensor meand detecting the arrival of the rear and front edges to their respective predetermined positions, and generating a signal which causes the front and rear edges to be held in their respective predetermined position by means provided for this effect.

15. Device as claimed in claim 13, wherein said means provided for holding the front and rear edges in their respective predetermined position are constituted by front and rear clamping belts adapted to be lowered on to the piece, close to the said edges.

16. Device as claimed in claim 15, wherein said means are endless belts adapted to rotate and to at least start moving the piece in the second direction.

17. Device as claimed in claim 16, wherein said belts alone move the piece in the second direction, and comprise a fixed portion situated higher up, for example on the level of the hemming means and a movable portion also higher up, situated for example above the area where the front and rear edges of a piece are held in their predetermined position.

18. Device as claimed in claim 17, wherein the endless belts rotate continually except while the movable part of the front belt is lowered and while the movable part of the rear belt is raised.

19. Device as claimed in claim 16, wherein the belts are vertically movable as a whole and only contribute to starting to move the piece in the second direction, the device being provided downstream of said belts with stationary means taking over the driving of the piece in the second direction.

20. Device as claimed in claim 13, wherein said device is provided with an endless belt for moving each piece in the first direction.

21. Device as claimed in claim 13, wherein said device comprises a roller for moving the pieces of fabric, which roller is situated between the means provided at the front and at the rear for clamping the front and rear edges in position.

22. Device as claimed in claim 13, wherein said device comprises an abutment transverse to the first direction, and with sensor means associated to a time-delay circuit so that the means provided for clamping the front edge in position are actuated after the front edge of a piece has been aligned with the abutment.

23. Device as claimed in claim 13, wherein the hemming means are provided, from upstream to downstream, with left and right edge-guides, left and right hem-guides, and left and right sewing heads.

24. Device as claimed in claim 13, wherein said device is further provided with means for drawing a continuous web of fabric from a roll of fabric and for moving said web in the first direction, as well as means for cutting in said web transversely to the first direction, a piece of fabric to size.

25. Device as claimed in claim 24, wherein said device comprises upstream of the cutting means, means for hemming the two selvages of the continuous web of fabric.

26. Device as claimed in claim 13, wherein said device further comprises means for folding and stacking the processed pieces.

* * * * *